United States Patent [19]

Welch

[11] Patent Number: 4,472,167

[45] Date of Patent: Sep. 18, 1984

[54] MILD-CURE FORMALDEHYDE-FREE DURABLE-PRESS FINISHING OF COTTON TEXTILES WITH GLYOXAL AND GLYCOLS

[75] Inventor: Clark M. Welch, Metairie, La.

[73] Assignee: The United States of America as represented by the Secretary of Agriculture, Washington, D.C.

[21] Appl. No.: 526,752

[22] Filed: Aug. 26, 1983

[51] Int. Cl.[3] ..... D06M 13/12

[52] U.S. Cl. ..... 8/116.4; 8/DIG. 17

[58] Field of Search ..... 8/116.4

[56] References Cited

U.S. PATENT DOCUMENTS

| | | | |
|---|---|---|---|
| 2,826,514 | 3/1958 | Schroeder | 8/116.4 |
| 3,434,794 | 3/1969 | Tovey | 8/116.4 |
| 3,451,763 | 6/1969 | Weiss | 8/116.4 |
| 4,269,603 | 5/1981 | Worth . | |

OTHER PUBLICATIONS

Llwood J. Gonzales and John D. Guthrie, "Crosslinking Cotton Cellulose with Glyoxal Reaction Products", *American Dyestuff Reporter* 58 [3] 27–29 (1969).

Pastyr et al., *Chemical Abstracts* 89 131030v, "Modification of Hydroxyethyl Cellulose Fibers and Foils" (1978).

Welch, Clark M. and Forthright Danna, "Glyoxal as a Non-Nitrogenous Formaldehyde-Free Durable-Press Reagent for Cotton" *Textile Research Journal* 52 149–157 (1982).

U. Meyer et al., "Comparison of Catalytic Activities and Textile Mechanical Properties Observed in the Crosslinking of Cotton with Highly Active Catalysts", *Textile Research Journal* 46 691–697 (1976).

Meyer et al., "Comparison of Textile Mechanical Properties of Cotton in Crosslinking with Dimethylolethyleneurea and Formaldehyde", *Textile Research Journal* 46 813–817 (1976).

*Primary Examiner*—Maria Parrish Tungol

*Attorney, Agent, or Firm*—M. Howard Silverstein; David G. McConnell; Raymond C. VonBodungen

[57] ABSTRACT

The use of glycols as coreactive additives with glyoxal in the aluminum sulfate-catalyzed crosslinking of cotton cellulose in the presence of alpha-hydroxy acids as catalyst activators at moderate curing temperatures is disclosed. The cotton textiles so treated are free from the discoloration and excessive tendering produced by glyoxal in the presence of metal salt catalysts at high temperature, are non-nitrogenous and formaldehyde-free, and exhibit high levels of wrinkle resistance and smooth drying properties without the formaldehyde release characteristic of N-methylolamide finishing agents.

8 Claims, No Drawings

MILD-CURE FORMALDEHYDE-FREE DURABLE-PRESS FINISHING OF COTTON TEXTILES WITH GLYOXAL AND GLYCOLS

BACKGROUND OF THE INVENTION

1. Field of the Invention

This invention relates to a new formaldehyde-free process for imparting wrinkle resistance and smooth drying properties to textiles.

2. Description of the Prior Art

Many types of cellulose crosslinking agents have previously been proposed as durable press finishing reagents to render cotton textiles wrinkle resistant in the dry state at ordinary humidity, and to make such textiles smooth drying when laundered in the wet state and then dried. In actual practice however, commercial high-speed durable press finishing of fabric is carried out exclusively with formaldehyde derivatives of cyclic and acyclic ureas or amides, and those derivatives are commonly referred to as N-methylol agents or N-methylolamides. They have the advantage of a high rate of reaction with cotton cellulose, they have been shown to cause less strength loss in the fabric than does formaldehyde or other non-nitrogenous agents, as conventionally applied, and they are readily available at low cost.

However, without exception, the N-methylol agents have the disadvantage of releasing vapors of free formaldehyde continuously during the durable press treatment of fabric, subsequent storage of finished fabric, garment manufacture from finished fabric, finished garment storage in retail outlets, and finally in the use of finished textile or apparel goods by the consumer. The widely observed irritating effect of formaldehyde vapor released by the treated fabric, effects on the eyes and skin of persons handling or wearing durable press textiles and garments, and the knowledge that formaldehyde is a carcinogen in test animals and may be a carcinogen in humans, has created a need for durable press finishing agents that are not based on formaldehyde or its derivatives.

It is known from the work of Gonzales et al, American Dyestuff Reporter 58 [3] 27–29 (1969) that glyoxal, also known as ethanedial, the structure of which in monomeric anhydrous form is O═CH—CH═O, shows marked reactivity toward cotton cellulose when applied in the presence of magnesium chloride and crosslinks the cellulose to impart a moderate level of wrinkle resistance to cotton fabric. Although the fabric weight gains obtained with glyoxal alone correspond to a low reaction efficiency, the presence of glycolic acid increased the rate of reaction and the final wrinkle recovery considerably. However, the strength losses also increased, being 70% for breaking strength and 75% for tearing strength. The use of aluminum nitrate, sulfate and chloride catalysts with mixtures of glyoxal and dimethylol urea to crosslink hydroxyethylcellulose was described by Pastyr et al, Czechoslovakian Pat. No. 172, 160 (Chemical Abstracts 89 131030v (1978)).

Worth (U.S. Pat. No. 4,269,603) has shown that a combination of aluminum sulfate and magnesium sulfate catalyze the crosslinking of cotton by glyoxal in the presence of a "reactive silicone" as fabric softener. Extremely high curing temperatures of 350°–400° F., corresponding to 177°–204° C., were preferred. It is known that cotton yarn and fabric lose strength fairly rapidly at these temperatures in air. The strength properties of treated fabrics were satisfactory in the case of blend fabrics containing 65% polyester-35% cotton, where most of the strength was provided by the polyester fibers, but the strength retentions were not disclosed in the case of fabrics containing as much as 50%–100% cotton. High levels of wrinkle resistance and smooth drying performance were imparted at all levels of cotton content in the fabrics. It was subsequently shown by Welch et al, *Textile Research Journal* 52 149–157 (1982) that aluminum sulfate was a highly effective catalyst for glyoxal crosslinking of cotton at 140°–155° C., but even at these more moderate cure temperatures, extremely high strength losses occurred when treating 100% cotton fabric. Even with a fabric softener present, tearing strength losses were 71%–74% and breaking strength losses were 72%–73% when applying a moderate concentration of glyoxal. Yellowing occurred in heat curing the fabric, unless ethylene glycol or glycerol were present as coreactant additives in the glyoxal-aluminum sulfate formulation which was applied to the fabric. The additives noticeably increased the durable press appearance ratings, but slightly decreased the wrinkle recovery angles. Attempts to use metal halides as catalysts were unsuccessful because of the fabric discoloration they produced under the conditions required to impart useful levels of wrinkle resistance and smooth drying performance. Moreover, the use of glycolic acid as an activator for a magnesium chloride catalyst increased the fabric yellowing during the cure, even through the cure temperature needed was lowered by the glycolic acid.

A further reference pertinent to the present invention is that of Meyer et al, *Textile Research Journal* 46 691–697 (1976). Since alpha-hydroxy acids are known to be catalyst activators primarily with metal halide catalysts, a comparison of the use of tartaric acid with nine different metal halides was made to determine if improved strength retention during durable press finishing to a given level of wrinkle recovery angle could be obtained at the lower cure temperatures made possible by the presence of the tartaric acid. Meyer et al conclusively demonstrated that with formaldehyde as the non-nitrogenous durable press reagent, "a very small, barely significant improvement" in textile strength retention was obtained on lowering the cure temperature to 85°–125°, as compared to 160° C. used without the tartaric acid as catalyst activator. By contrast, the nitrogenous durable press reagent, dimethylolethyleneurea (DMEU), a widely used N-methylol agent, showed a very significant improvement in textile strength retention when cured at the lower temperatures with tartaric acid-metal halide catalyst as compared to high temperature curing without the tartaric acid as activator. In a second study, Meyer et al, *Textile Research Journal* 46 813–817 (1976) concluded that the poorer strength retention obtained with formaldehyde than with DMEU is due to greater acid-catalyzed degradation of cotton cellulose during the heat cure with formaldehyde, than occurs with DMEU as the durable press reagent. The strength retention was stated to increase, the higher the concentration of DMEU used, and the observation was made that DMEU buffers acid catalysts to partially supress cellulose degradation by the acid catalyst. These prior art results suggest that increased strength loss is inherent to the use of a non-nitrogenous cellulose crosslinking agent in acid-catalyzed durable-press finishing of fabrics high in cotton content.

SUMMARY OF THE INVENTION

This invention provides processes for imparting to cotton and other cellulosic textiles a high level of wrinkle resistance and smooth drying properties by means of a nonnitrogenous finish, without the use of formaldehyde or formaldehyde-releasing derivatives, and while retaining the tearing strength, breaking strength and freedom from discoloration to a degree comparable to treatments with conventional N-methylolamides.

In these processes glyoxal and a glycol are coreacted with the cellulosic textile in the presence of aluminum sulfate catalyst and an alpha-hydroxy acid as catalyst activator, with the presence of fabric softeners optional, in a pad, dry, and heat cure operation, utilizing mild curing temperatures. Use of the glycol increases the durable press appearance rating and wrinkle recovery angle obtained in treated fabric, lowers the catalyst concentration and cure temperature required, and suppresses yellowing of the fabric during the heat cure. Glycols suitable as coreactants with the glyoxal and the cellulosic textiles are those glycols having a molecular chain of from 2 to 11 atoms in length connecting two terminal hydroxyl groups, with a chain length of 4–8 atoms being particularly preferred, and the atoms in the chain being carbon or oxygen, the latter when present being ether linkages.

The main object of the present invention is to provide a process for improving the wrinkle resistance and smooth drying characteristics of cotton-containing textiles, without applying finishes which contain or release formaldehyde during the finishing process, subsequent storage of the treated textiles, or during the subsequent handling and use of the treated textiles.

A second object of the present invention is to provide a durable press process for cotton textile that produces a non-nitrogenous finish on the textile while retaining in the textile high levels of breaking and tearing strength comparable to those of textiles treated with conventional N-methylolamides to a specified level of wrinkle recovery angle and durable press appearance rating.

A third object of the present invention is to provide a formaldehyde-free durable press finish for cotton that does not discolor the fabric more than conventional durable press finishing with N-methylolamides.

DESCRIPTION OF THE PREFERRED EMBODIMENTS

The present invention is applicable to textiles containing not less than 30% by weight of cellulosic fibers including cotton, flax, jute, hemp, ramie and regenerated unsubstituted wood celluloses such as rayon. The processes disclosed are most advantageous with textiles containing 50%–100% cotton and may be applied to fibers or linters, roving, sliver, yarns, woven or knit fabrics, as well as nonwoven textiles and paper.

The present invention is based on the discovery that the acid-catalyzed chemical reaction of glyoxal with the cellulose in a textile is fundamentally altered by the presence of a glycol when a water solution of the glyoxal, glycol, aluminum sulfate catalyst, and an alpha-hydroxy acid present to activate the aluminum sulfate catalyst is applied to the cellulosic textile, the impregnated textile is dried at 45°–105° C. for from 0.5 minutes to 30 minutes, and the textile is heated to a temperature of 110°–135° C. for periods of 0.5–5.0 minutes, the higher temperatures being applied for the shorter times. The glycol is observed to increase the effectiveness of the crosslinking introduced into the cellulose by the glyoxal, in terms of the level of wrinkle resistance and smooth drying properties imparted at a given glyoxal concentration. Moreover, the textile yellowing normally occurring in the reaction of glyoxal with the cellulose is suppressed by the glycol, partly because of the lower cure temperatures and catalyst concentrations that are effective when a glycol is present, and partly because of the reactions in which the glycol takes part as a coreactant.

The greatly increased fabric weight gains occurring when a glycol is used as a coreactant additive with the glyoxal prove that the glycol is bonded to cellulose by the glyoxal. The way in which these weight gains vary with increasing mole ratios of glycol/glyoxal suggests that the glycol reacts during the heat curing step with cellulose hemiacetals of glyoxal previously formed during the fabric drying step carried out prior to the heat curing step. Thus the glycol serves to modify the structure of the crosslinks formed by glyoxal in the cellulose of the textile material. The beneficial effects of the glycol in enhancing the level of wrinkle resistance and durable press performance are found to depend greatly on the molecular chain length of the glycol. It is preferable that the two hydroxyl groups of the glycol molecule be primary hydroxyl groups, $—CH_2OH$, and that these hydroxyl groups be located at terminal positions of a molecular chain.

Glycols suitable for the processes of this invention include terminal straight-chain alkanediols having a hydroxyl group attached to each of the two terminal carbon atoms of the chain, and thus having the structure $HO—(CH_2)_x—OH$, where x is from 2 to 11, and also suitable are poly(ethylene glycols) having the structure $HO—(CH_2—CH_2—O)_y—H$ where y is from 2 to 4. Trihydric alcohols such as glycerol have proven considerably less effective in enhancing the wrinkle resistance and durable press properties imparted in the present processes, and it is thought that such alcohols may interfere with hemiacetal formation between glyoxal and cellulose that normally occurs during the fabric drying step prior to heat curing.

The simplest glycol, ethylene glycol, is fully effective in enhancing the durable press appearance ratings of the cellulosic textile only at cure temperatures of 125° C. or higher, and is inoperative at a cure temperature as low as 115° C. By contrast, the longer chain glycols remain highly effective even when curing at the lower temperatures. Since the breaking and tearing strength retention are greatest at the lower cure temperatures, and freedom from yellowing during the heat cure is also most complete at the lower cure temperatures, the use of glycols of a chain length longer than that of ethylene glycol is greatly preferred. Examples of the most effective glycols are 1,4-butanediol, diethylene glycol which is also known as bis(2-hydroxyethyl) ether, and triethylene glycol which is also known as 1,2-bis(2hydroxyethoxy) ethane. Diethylene glycol, having the molecular structure $HOCH_2CH_2OCH_2CH_2OH$, is particularly preferred.

Glyoxal used in the present processes is preferably the commercial grade material commonly supplied as a 40% aqueous solution, or less preferably, the solid trimer, also commercially available. Proprietary glyoxal preparations containing formaldehyde as a by-product of one particular method of glyoxal synthesis are not suitable for the present process where it is desired to avoid completely the presence of releasable formaldehyde in textile processing, subsequent fabric storage, and final use of the treated fabric. A glyoxal concentration of from 1.0% to 10% by weight is operative in the present process, with 1.5%–6.0% preferred.

The mole ratio of glycol to glyoxal in the fabric treating bath may be from 0.5:1 to 8:1 but the most advantageous ratios from the standpoint of durable press performance fabric strength retention, whiteness retention and economy are in the range of 0.9:1 to 3.0:1.

The preferred catalyst for the present process is aluminum sulfate together with an alpha-hydroxy carboxylic acid. The aluminum sulfate, $Al_2(SO_4)_3$, may be introduced to the fabric treating bath as the anhydrous salt or may be in hydrated forms such as $Al_2(SO_4)_3.16H_2O$ or $Al_2(SO_4)_3.18H_2O$. The concentration of anhydrous aluminum sulfate operative in the present processes is in the range of from 0.15% to 0.50% by weight, a greater amount by weight being required of the hydrated forms, in direct proportion to their molecular weight. With higher concentrations of catalyst than are specified here, yarn or fabric tendering becomes excessive, and yellowing of the textile also occurs.

Alpha-hydroxy carboxylic acids suitable as catalyst activators for the present processes are those which are watersoluble and have an acid ionization constant in the range of from $1\times10^{-4}$ to $3\times10^{-3}$. Stronger acids than this are found to produce tendering and yellowing of the cellulosic textile. Examples of suitable alpha-hydroxy acids are glycolic acid, lactic acid, tartaric acid, citric acid and malic acid. The most effective are tartaric and citric acid. The tartaric acid used may be the common, naturally occurring dextrorotatory enantiomer, hereafter designated as d-tartaric acid, or may be the levorotatory enantiomer or the racemic 1:1 molecular compound of the two enantiomers, or less preferably, the meso-diastereomer. The function of the alpha-hydroxy acid is to form with the aluminum sulfate a complex that is more acidic and a more effective catalyst than is aluminum sulfate alone; hence the alpha-hydroxy acid is referred to as a catalyst activator. The mole ratio of alpha-hydroxy carboxylic acid to aluminum sulfate required in the present processes is in the range from 1.5:1 to 15:1, being lower for hydroxy dicarboxylic acids than for hydroxy monocarboxylic acids. A 2:1–5:1 mole ratio is especially preferable with tartaric acid.

The use of emulsified polyethylene or silicones as fabric softeners in the treating bath is optional in the present processes. Both types of softener increased the wrinkle recovery angle and durable press appearance rating produced in the treated textiles.

Silanol-terminated silicone softener appeared noticeably more effective in this regard than polyethylene softeners, but had the characteristic of imparting considerable water repellency to the cellulosic textile and this is a marked disadvantage in the durable press finishing of garments such as shirts, pajamas and dresses in which high and rapid moisture absorption by the textile fibers is important to the removal of perspiration and to clothing comfort. Nonionic polyethylene softener was more effective than cationic polyethylene in increasing the wrinkle recovery and durable press rating. Use of the cationic polyethylene required curing at a higher temperature due to a buffering effect which raised the pH of the treating bath by as much as 0.5 units and decreased the activity of the catalyst.

The use of nonionic wetting agents is also an option feasible in the present process.

In carrying out the textile treatments of this invention, the cellulosic textile is impregnated in the treating bath made up as described above, and is freed of excess treating solution. It is then preferably dried prior to the heat cure, in order that the initial addition of glyoxal to the cellulose to form hemiacetal derivatives of cellulose can be completed before the glycol that is present enters into reaction under the influence of the activated catalyst and the elevated temperature used in heat curing. It is to be recognized however, that even if the drying step prior to the heat cure is omitted, so that drying and curing are carried out in a single step, it is still possible for the desired hemiacetal formation to occur as the water solvent is rapidly vaporized, and the desired curing reactions of the cellulose hemiacetals of glyoxal can then proceed with the glycol coreactant.

The above observations have been used to develop a mild-cure, formaldehyde-free process for the durable press finishing of cellulosic textiles, which process comprises the following steps: (a) immersion of the cellulosic textile in an aqueous treating solution containing from 1% to 10% by weight of glyoxal, from 0.5 mole to 8 moles of a glycol per mole of glyoxal present, which glycol has a molecular chain of from 2 to 11 atoms in length connecting two terminal hydroxyl groups, said glycol being selected from the class consisting of terminal straight-chain alkanediols and poly(ethylene glycols), there also being present in the solution from 0.15% to 0.50% by weight of aluminum sulfate having the formula $Al_2(SO_4)_3$, and a water-soluble alpha-hydroxy carboxylic acid having an acid ionization constant of from $1\times10^{-4}$ to $3\times10^{-3}$ and present to the extent of from 1.5 mole to 15 moles per mole of aluminum sulfate present and optionally a polymeric fabric softening agent dispersed as a colloidal emulsion in said solution, (b) removal of excess treating solution from the textile, (c) drying the textile at a temperature of from 45° to 105° C. for a period of from 0.5 minutes to 30 minutes, (d) heating the cellulosic textile at a temperature of from 110° C. to 135° C. for a period of from 0.5 to 5 minutes to form the glycol-modified glyoxal cross-links in the cellulose, (e) washing the textile with water to remove excess reagents, and (f) drying the textile.

In the examples to be given, the properties of the treated fabrics were measured by standard test methods, which were as follows: conditioned and wet wrinkle recovery angle - ASTM method D-1295-67. Elmendorf tearing strength- ASTM Method D-1424-63, strip breaking strength - ASTM Method D-1682-64, durable press appearance ratings - AATCC Method 124-1967 using as standards plastic replicas for comparison with treated fabric given one machine laundering and tumble drying cycle.

The following examples are illustrative of processes of the present invention, and are not intended to limit the scope of the invention. All parts and percentages are by weight.

EXAMPLE 1

Alpha-Hydroxy Acids as Catalyst Activators for the Mild-Cure Durable Press Finishing of Cotton Fabrics with Glyoxal and Ethylene Glycol An aqueous treating bath was prepared containing 4.8% by weight of glyoxal, 5.2% of ethylene glycol, 0.77% $Al_2(SO_4)_3.16H_2O$ as the aluminum sulfate catalyst, an alpha-hydroxy acid as the catalyst activator as specified in Table I, a 1% solids concentration of a commercial aqueous emulsion of a silanol-terminated poly(dimethylsiloxane) of molecular weight 20,000 as the fabric softening agent, and water. The mole ratio of ethylene glycol to glyoxal was 1:1 in this bath.

An all-cotton desized, scoured and bleached 80×80 printcloth weighing 3.2 oz/yd$^2$ was thoroughly wet by immersion in this treating bath, was passed between the rolls of a wringer, was again immersed in the treating bath and was again passed through the wringer, the pressure of the wringer rolls being sufficient to give a wet pickup of 108%–118% of mixture on the fabric, based on the original weight of the fabric sample.

The fabric was then dried in a forced draft oven at 85° C. for 5 minutes, and was heat cured in a second forced draft oven at 125° C. for 2.0 minutes. The fabric was subsequently washed for 30 minutes in hot running water to remove any unreacted agents, and was oven-dried at 85° C. for 5 minutes.

The properties of the treated fabrics appear in Table I as a function of the alpha-hydroxy acid added as a catalyst activator. Succinic acid, which does not contain a hydroxyl group, is included for comparison purposes.

TABLE I

| Catalyst Activator | Mole Ratio Acid / $Al_2(SO_4)_3$ | Fabric Weight Gain | Wrinkle Recovery Angle (warp + fill) Conditioned | Wrinkle Recovery Angle (warp + fill) Wet | Durable Press Rating | Warp Tear Strength Retained | Warp Break Strength Retained |
|---|---|---|---|---|---|---|---|
| none | | 3.7% | 271° | 225° | 2.5 | 54% | 47% |
| 0.37% tartaric acid[a] | 2:1 | 7.5 | 301 | 280 | 4.2 | 36 | 32 |
| 0.18% tartaric acid[a] | 1:1 | 6.3 | 295 | 263 | 3.3 | 38 | 36 |
| 0.37% glycolic acid | 4:1 | 7.3 | 291 | 252 | 4.0 | 39 | 33 |
| 0.44% lactic acid | 4:1 | 6.9 | | | 3.7 | | |
| 0.47% citric acid | 2:1 | 6.7 | 295 | 268 | 4.1 | 35 | 32 |
| 0.32% malic acid | 2:1 | 5.9 | 283 | 239 | 4.0 | 39 | 36 |
| 0.28% succinic acid | 2:1 | 4.7 | | | 3.1 | | |
| (untreated fabric) | | | 200 | 174 | 1.0 | (100) | (100) |

[a]The dextrorotatory enantiomer, often designated as d-tartaric acid.

The data show that in the absence of a catalyst activator in the treating bath, the durable press appearance ratings of the fabric given the mild cure treatment at 125° C. were unsatisfactory after machine laundering. A durable press rating of 3.5 or higher is required for acceptable smooth drying performance in commercial usage. However, if an alpha-hydroxy acid were present as a catalyst activator in the treating bath, a high level of wrinkle resistance and durable press properties were imparted.

The most effective catalyst activators were tartaric acid and citric acid. Even though present in amounts far too small to significantly alter the fabric or finish composition, the alpha-hydroxy acids greatly increased the fabric weight gain during treatment. The weight gains are another measure of the extent of reaction of the cotton cellulose with the glyoxal-glycol coreactant mixture in the presence of aluminum sulfate catalyst. Succinic acid, which lacks a hydroxyl group but otherwise has a molecular structure similar to tartaric acid, was only slightly effective as a catalyst activator under these conditions, and only slightly increased the durable press rating or fabric weight gain.

EXAMPLE 2

Effects of Ethylene Glycol as a Coreactant Additive in Mild Cure Finishing with Glyoxal An aqueous treating bath was prepared containing 4.8% by weight of glyoxal, the amount of ethylene glycol specified in Table II, 0.37% d-tartaric acid as catalyst activator, 0.77% $Al_2(SO_4)_3.16H_2O$ as the aluminum sulfate catalyst, a commercial fabric softening agent as specified in Table II, and water.

An all-cotton desized, scoured and bleached 80×80 printcloth weighing 3.2 oz/yd$^2$, the same base fabric as used in Example 1, was thoroughly wet by immersion in this treating bath, was passed between the rolls of a wringer, was again immersed in the treating bath, and was again passed through the wringer, the pressure of the wringer rolls being sufficient to give a wet pickup of 108%–118% of treating mixture on the fabric, based on the original weight of the fabric sample.

The fabric was then dried in a forced draft oven at 85° C. for 5 minutes, and was heat cured in a second forced draft oven for 2.0 minutes at a temperature specified in Table II. The fabric was subsequently washed for 30 minutes in hot running water to remove any unreacted agents, and was oven-dried at 85° C. for 5 minutes.

The properties of the treated fabrics appear in Table II as a function of the presence or absence of ethylene glycol as a coreactant in the treating bath, the type of fabric softening agent used, and the curing temperature.

TABLE II

| Ethylene Glycol Concentration | Fabric Softener[a] | Cure Temp. | Fabric Weight Gain | Wrinkle Recovery Angle (warp + fill) Conditioned | Wrinkle Recovery Angle (warp + fill) Wet | Durable Press Rating | Warp Tear Strength Retained | Warp Break Strength Retained |
|---|---|---|---|---|---|---|---|---|
| 0% | silicone | 125° C. | 2.9% | 295 | 274 | 3.0 | 34% | 43% |
| 5.2 | silicone | 125[b] | 7.5 | 301 | 280 | 4.2 | 36 | 32 |
| 5.2 | silicone | 120 | 6.0 | 289 | 278 | 4.0 | 37 | 42 |
| 0 | cationic PE | 135 | 3.2 | 303 | 279 | 3.1 | 34 | 35 |
| 5.2 | cationic PE | 135 | 7.7 | 308 | 285 | 3.8 | 35 | 35 |
| 5.2 | cationic PE | 130 | 6.8 | 305 | 263 | 3.6 | 40 | 34 |
| 0 | nonionic PE | 135 | 4.7 | 310 | 290 | 3.2 | 28 | 32 |
| 5.2 | nonionic PE | 135 | 7.8 | 307 | 292 | 4.3 | 31 | 27 |
| 5.2 | nonionic PE | 130 | 6.6 | 312 | 275 | 4.0 | 34 | 32 |
| 5.2 | nonionic PE | 125 | 6.1 | 305 | 268 | 3.9 | 38 | 35 |
| 5.2 | nonionic PE | 135[c] | 6.8 | 307 | 277 | 3.2 | 35 | 31 |

TABLE II-continued

| Ethylene Glycol Concentration | Fabric Softener[a] | Cure Temp. | Fabric Weight Gain | Wrinkle Recovery Angle (warp + fill) Conditioned | Wet | Durable Press Rating | Warp Tear Strength Retained | Warp Break Strength Retained |
|---|---|---|---|---|---|---|---|---|
| (untreated fabric) | | | | 200 | 174 | 1.0 | (100) | (100) |

[a]Silicone - a commercial emulsified silanol-terminated poly(dimethylsiloxane) softener of molecular weight 20,000, used at a solids concentration of 1.0%.
cationic PE - a commercial emulsified cationic polyethylene softener, used at a solids concentration of 1.2%.
nonionic PE - a commercial emulsified nonionic polyethylene softener, used at a solids concentration of 1.0%
[b]This run is the same as run 2 of Table I.
[c]Cure time was 1.0 minutes in this run.

The data show that the presence of ethylene glycol in the treating bath was essential to the success of the durable press treatments at the mild cure temperatures employed. In the absence of ethylene glycol as a co-reactant with glyoxal the durable press appearance ratings were considerably below the minimum level of 3.5 required for satisfactory smooth drying properties during machine laundering. With ethylene glycol present, durable press ratings of 3.6–4.3 were readily obtained.

Moreover the process was operable regardless of the type of fabric softener used, and the tearing strength retained in treated fabric markedly exceeded the values of 26–29% previously reported for the glyoxal finishing of all-cotton printcloth by conventional high temperature curing. Likewise the breaking strength retained at the mild curing temperatures used here exceeded the values of 27%–28% previously reported for high temperature curing in the presence of a fabric softener.

An additional observation made on the treated fabrics was that when the cure temperature was 130° C. or lower, the degree of whiteness retained in the fabrics during the process was noticeably greater than that of fabrics conventionally treated with glyoxal and cured at temperatures of 140°–150° C. The level of whiteness retained when using the silicone or nonionic polyethylene softener in the present process was superior to that retained with the cationic polyethylene softener present, owing in part to the higher cure temperatures required with the cationic softener, and in part to the greater yellowing tendency of the cationic softener.

EXAMPLE 3

Effect of Glycol/Glyoxal Mole Ratio

An aqueous treating bath was prepared containing 4.8% by weight of glyoxal, a glycol specified in Table III as to kind and amount, 0.77% $Al_2(SO_4)_3.16H_2O$ as the aluminum sulfate catalyst, 0.37% d-tartaric acid as catalyst activator, a 1% solids concentration of a commercial aqueous emulsion of a silanol-terminated poly(-dimethylsiloxane) of molecular weight 20,000 as a fabric softener, and water.

An all-cotton desized, scoured and bleached 80 ×80 printcloth weighing 3.2 oz/yd$^2$ was thoroughly wet by immersion in the treating bath, was passed between the rolls of a wringer, was again immersed in the treating bath and was again passed through the wringer, the pressure of the wringer being sufficient to give a wet pickup of 108%–118% of the treating mixture on the fabric, based on the original weight of the fabric sample.

The fabric was then dried in a forced draft oven at 85° C. for 5 minutes, and was heat cured in a second forced draft oven at 125° C. for 2.0 minutes. The fabric was subsequently washed for 30 minutes in hot running water to remove any unreacted agents, and was oven dried at 85° C. for 5 minutes.

The durable-press properties of the treated fabrics appear in Table III as a function of the kind of glycol added and the mole ratio of glycol to glyoxal used in the treating bath.

TABLE III

| Glycol[a] | | Mole Ratio Glycol/Glyoxal | Fabric Weight Gain | Durable Press Rating |
|---|---|---|---|---|
| | none | | 2.9% | 3.0 |
| 2.6% | ethylene glycol | 0.5:1 | 4.6 | 3.5 |
| 5.2% | ethylene glycol | 1:1 | 7.5 | 4.2 |
| 10.3% | ethylene glycol | 2:1 | 7.4 | 3.9 |
| 20.6% | ethylene glycol | 4:1 | 7.2 | 4.0 |
| 41.3% | ethylene glycol | 8:1 | 7.9 | 3.8 |
| 8.8% | diethylene glycol | 1:1 | 13.8 | 4.5 |
| 17.7% | diethylene glycol | 2:1 | 17.0 | 4.5 |
| 26.5% | diethylene glycol | 3:1 | 19.1 | —[b] |

[a]Ethylene glycol has the molecular formula $HOCH_2CH_2OH$ and is also known as 1,2-dihydroxyethane.
Diethylene glycol has the molecular formula $HOCH_2CH_2OCH_2CH_2OH$ and is also known as bis(2-hydroxyethyl)ether.
[b]Fabric was stiff due to high add-on.

The data show that with ethylene glycol as a coreactant additive for the glyoxal-containing treating bath, the fabric weight gain during treatment steadily increased as the glycol concentration was increased up to a glycol concentration of 5.2% which corresponded to a glycol/glyoxal mole ratio of 1:1. Further increases in ethylene glycol concentration did not cause any further change in fabric weight gains. Likewise the durable press ratings increased with increasing ethylene glycol concentration up to a glycol/glyoxal mole ratio of 1:1, and remained fairly constant with further increases in glycol concentration.

By contrast, the addition of diethylene glycol to the treating bath caused a continuous increase in fabric weight gain as the concentration of this glycol was increased even up to a glycol/glyoxal mole ratio of 3:1. The durable press ratings remained constant at mole ratios of 1:1–2:1 and in this range were higher than for the ethylene glycol.

The results show that during the cure the glycol which was added to the glyoxal-containing bath reacted with the glyoxal-cellulose adduct initially formed during drying and was thereby bound during the heat curing step to the cotton fabric. The nature and course of this reaction depended on the chain length of the added glycol, but with either glycol used here, the durable press appearance rating of the fabric was increased by the added glycol as long as the fabric weight gain did not exceed approximately 17%. Higher weight gains stiffened the fabric and adversely affected textile performance properties.

EXAMPLE 4

Effects of Glycol Chain Length, Catalyst Concentration and Cure Temperature

An aqueous treating bath was prepared containing 4.8% by weight of glyoxal, a glycol as specified in Table IV, the concentration of $Al_2(SO_4)_3.16H_2O$ aluminum sulfate catalyst specified in Table IV, 0.37% d-tartaric acid as the catalyst activator, a 1% solids concentration of a commercial aqueous emulsion of a silanol-terminated poly (dimethylsiloxane) of molecular weight 20,000 as the fabric softening agent, and water. The mole ratio of glycol to glyoxal in this bath was 1:1.

An all-cotton desized, scoured and bleached 80×80 printcloth weighing 3.2 oz/yd$^2$, the same base fabric as used in Example 1, was thoroughly wet by immersion in this treating bath, was passed between the rolls of a wringer, was again immersed in the treating bath, and was again passed through the wringer, the pressure of the wringer rolls being sufficient to give a wet pickup of 108%–118% of treating mixtures on the fabric, based on the original weight of the fabric sample.

The fabric was then dried in a forced draft oven at 85° C. for 5 minutes, and was heat-cured in a second forced draft oven for 2.0 minutes at a temperature specified in Table IV. The fabric was subsequently washed for 30 minutes in hot running water to remove any unreacted agents, and was oven-dried at 85° C. for 5 minutes.

The properties of the treated fabrics appear in Table IV as a function of the glycol added as a coreactant with glyoxal, the catalyst concentration, and the cure temperature used. The properties of fabric conventionally treated with a commercial nitrogenous durable press finishing agent, dimethyloldihydroxyethyleneurea (DMDHEU), are also shown for purposes of comparison.

TABLE IV

| Glycol[a] | Catalyst Concen. | Cure Temp. | Fabric Weight Gain | Wrinkle Recovery Angle (warp + fill) Conditioned | Wrinkle Recovery Angle (warp + fill) Wet | Durable Press Rating | Warp Tear Strength Retained | Warp Break Strength Retained |
|---|---|---|---|---|---|---|---|---|
| none | 0.38% | 125° C. | 2.5% | 271° | 242° | 2.8 | 47% | 41% |
| 5.2% ethylene glycol | 0.38 | 125 | 6.1 | 283 | 260 | 4.0 | 39 | 41 |
| 6.3% 1,3-propanediol | 0.38 | 125 | 6.8 | 289 | 267 | 4.1 | 43 | 41 |
| 7.5% 1,4-butanediol | 0.38 | 125 | 9.6 | 302 | 222 | 4.5 | 41 | 45 |
| 8.8% diethylene glycol | 0.38 | 125 | 10.4 | 306 | 283 | 4.3 | 35 | 42 |
| 5.2% ethylene glycol | 0.19 | 125 | 3.4 | | | 2.6 | | |
| none | 0.38 | 120 | 2.0 | | | 2.4 | | |
| 5.2% ethylene glycol | 0.38 | 120 | 5.3 | 269 | 237 | 3.7 | 44 | 41 |
| 8.8% diethylene glycol | 0.38 | 120 | 11.2 | 303 | 272 | 4.5 | 42 | 42 |
| 8.8% diethylene glycol | 0.20 | 120 | 4.4 | | | 2.9 | | |
| none | 0.38 | 115 | 2.0 | 237 | 219 | 2.5 | 59 | 52 |
| 5.2% ethylene glycol | 0.38 | 115 | 4.0 | | | 2.5 | | |
| 7.5% 1,4-butanediol | 0.38 | 115 | 7.8 | 296 | 277 | 3.6 | 47 | 46 |
| 8.8% diethylene glycol | 0.38 | 115 | 9.0 | 298 | 253 | 4.0 | 46 | 48 |
| 12.5% triethylene glycol | 0.38 | 115 | 8.9 | 286 | 251 | 3.8 | 48 | 50 |
| (DMDHEU-treated fabric)[b] | | | 6.3 | 305 | 276 | 4.3 | 52 | 44 |
| (untreated fabric) | | | | 200 | 174 | 1.0 | (100) | (100) |

[a]The given concentrations of glycol correspond to a glycol/glyoxal mole ratio of 1:1.
[b]Fabric treated with 6.5% dimethyloldihydroxyethyleneurea-4% $MgCl_2.6H_2O$ - 1% nonionic polyethylene softener - 0.2% nonionic wetting agent, and dried at 80° C. for 5 min, followed by curing at 160° C. for 1.5 min, washing and drying.

The data show that when a catalyst concentration as low as 0.38% was used, the enhancement of the wrinkle recovery angle and durable press rating of treated fabric were even more strongly dependent on the chain length of the glycol added to the treating bath as a coreactant for the glyoxal, than was the case in the preceding examples where the catalyst concentratioh was twice as great. The wrinkle recovery angle and durable press rating increased with glycol chain length up to a chain length of 5 atoms, exclusive of terminal hydroxyl groups, and declined slightly for triethylene glycol, which has a chain length of 8 atoms, but in all cases, far exceed the wrinkle recovery and durable press rating imparted without the glycol additive.

The data also show that with glycols having a chain length of 4–8 atoms, exclusive of terminal hydroxyl groups, the process could readily be carried out at lower cure temperatures than were possible with ethylene glycol or with no glycol additive.

The combination of decreased catalyst concentration and lowered cure temperature resulted in improved retention of tearing and breaking strength. An additional observation was that the level of whiteness retained in fabrics treated at 120°–125° C. at a catalyst concentration of 0.38% $Al_2(SO_4)_3.16H_2O$ was equal to that of the DMDHEU-treated cloth, while the degree of whiteness in fabrics cured at 115° exceeded that of the DMDHEU-treated cloth.

EXAMPLE 5

Mild Cure Durable Press Glyoxal-Glycol Treatment of Cotton in Absence of Fabric Softeners An aqueous treating bath was prepared containing 4.8% by weight of glyoxal, 8.8% diethylene glycol, 0.38% $Al_2(SO_4)_3.16H_2O$ as the aluminum sulfate catalyst, 0.37% d-tartaric acid as the catalyst activator, and water.

An all-cotton desized, scoured and bleached 80×80 printcloth weighing 3.2 oz/yd$^2$, the same base fabric as used in Example 1, was thoroughly wet by immersion in this treating bath, was passed between the rolls of a wringer, was again immersed in the treating bath, and was again passed through the wringer, the pressure of the wringer rolls being sufficient to give a wet pickup of 108%–118% of treating mixture on the fabric, based on the original weight of the fabric sample.

The fabric was then dried in a forced draft oven at 85° C. for 5 minutes, and was heat cured in a second forced draft oven at 120° C. for 2.0 minutes. The fabric was subsequently washed for 30 minutes in hot running water to remove any unreacted agents, and was oven-dried at 85° C. for 5 minutes.

The gain in weight of the fabric, as a result of the durable press treatment, was 8.6%. The durable press appearance rating of this treated fabric was 3.9 after machine laundering and tumble drying, where 5.0 is the best possible smoothness rating, and 1.0 indicates no smooth drying properties are present. Untreated fabric gave a durable press appearance rating of 1.0.

Comparison of these results with data of Table IV shows that the durable press rating imparted by the present process in the absence of softeners was lower by 0.6 rating unit than when a softener was present, but was nevertheless well above the minimum level of 3.5%, considered essential for widespread commercial utility.

I claim:

1. A process for imparting a high level of wrinkle resistance and smooth drying properties to cellulosic textiles, without the use of formaldehyde, derivatives of formaldehyde, or agents that release formaldehyde, and without additional discoloration or excessive loss of strength in the textile, which process comprises:

(a) padding the cellulosic textile with an aqueous solution containing sufficient amounts of glyoxal, glycol, an aluminum salt of a strong inorganic acid, and a water soluble alpha-hydroxy carboxylic acid, to impregnate the cellulosic textile;

(b) removing excess treating solution from the textile and heating the textile for sufficient time at sufficient temperature to dry the textile;

(c) heating the textile at sufficient temperature and for a sufficient period of time to form the glycol-modified glyoxal durable-press finish in the cellulose.

2. The process of claim 1 including the additional steps of washing the textile with water to remove excess reagents and drying the textile after the excess reagents have been removed.

3. The process of claim 1 wherein the treating solution contains from about 1% to 10% by weight of glyoxal, from 0.5 to 8 moles of glycol for each mole of glyoxal present, which glycol has a molecular chain of from 2 to 11 atoms in length connecting two terminal hydroxyl groups, said glycol being selected from the group consisting of terminal straight-chain alkanediols and poly(ethylene glycols), there also being present in the solution from 0.15% to 0.50% by weight of aluminum sulfate having the formula $Al_2(SO_4)_3$, and also a watersoluble alpha-hydroxy carboxylic acid having an acid ionization constant from $1\times15^{-4}$ to $3\times10^{-3}$ and present to the extent of from 1.5 moles to 15 moles per mole of aluminum sulfate present.

4. The process of claim 3 wherein the textile is dried at from about 45° C. to 105° C. for a period of time from about 0.5 minutes to 30 minutes.

5. The process of claim 4 wherein the glycol-modified glyoxal durable-press finish is formed in the cellulose by heating the cellulosic textile at a temperature of from 110° C. to 135° C. for a period of time from about 0.5 to 5 minutes.

6. The process of claim 4 wherein the cellulosic textile is a cotton fabric.

7. The process of claim 4 wherein the glycol is selected from the group consisting of: ethylene glycol, an alpha,omega-alkanediol, 1,3-propanediol, 1,4-butanediol, poly(ethylene glycol), diethylene glycol, and triethylene glycol.

8. The process of claim 7 wherein the alpha-hydroxy carboxylic acid is selected from the group consisting of: glycolic acid, lactic acid, tartaric acid, citric acid, and malic acid.

* * * * *